US005819455A

United States Patent [19]

Tsuda

[11] Patent Number: 5,819,455

[45] Date of Patent: Oct. 13, 1998

[54] TRAFFIC SIGN MARKER

[75] Inventor: Yoshinori Tsuda, Nagano, Japan

[73] Assignee: Hataken Engineering Co., Ltd., Nagano, Japan

[21] Appl. No.: 812,962

[22] Filed: Mar. 5, 1997

[51] Int. Cl.[6] ..... E01F 9/00

[52] U.S. Cl. ..... 40/580; 40/550; 40/612

[58] Field of Search ..... 40/442, 452, 550, 40/577, 579, 580, 582, 612

[56] References Cited

U.S. PATENT DOCUMENTS 1,967,066 7/1934 Reilly ..... 40/550

FOREIGN PATENT DOCUMENTS 52-67599 6/1977 Japan .
2-20710 1/1990 Japan .

*Primary Examiner*—Cassandra H. Davis
*Attorney, Agent, or Firm*—Birch, Stewart, Kolasch & Birch, LLP

[57] ABSTRACT

A traffic sign marker 1 has a display surface portion 2 for displaying a graphic symbol A related to a traffic sign. The display surface portion 2 is provided with a first light emitting portion 3 arranged along an contour of the graphic symbol A, and a second light emitting portion 4 patterning the letters B corresponding to the graphic symbol A, and the sign marker 1 comprises an operation control portion for causing the first light emitting portion 3 and the second emitting portion 4 to emit light alternately. Whereby, the graphic symbol A related to the traffic sign and the letters B corresponding to the graphic symbol A are displayed alternately, so that it can be recognized accurately and immediately whether or not the sign is a traffic sign and what are the caution contents intended by the traffic sign, and then the sign can be visible clearly at an angle.

7 Claims, 5 Drawing Sheets

FIG.6
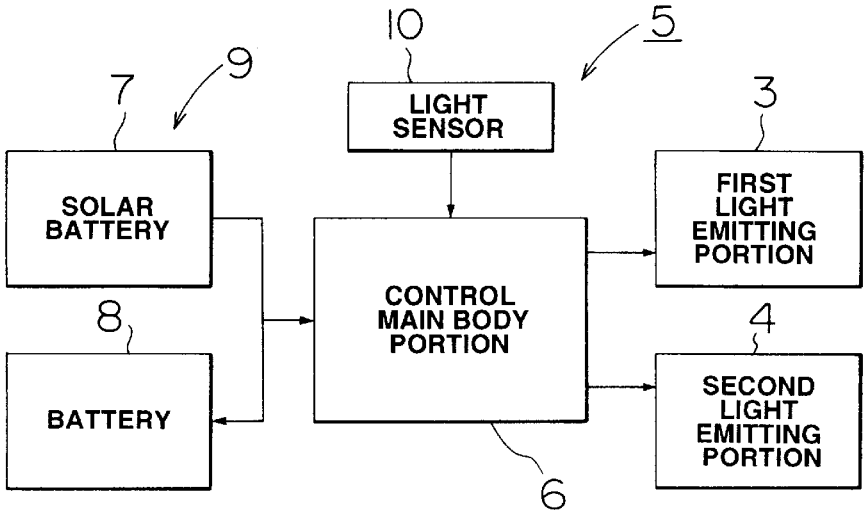
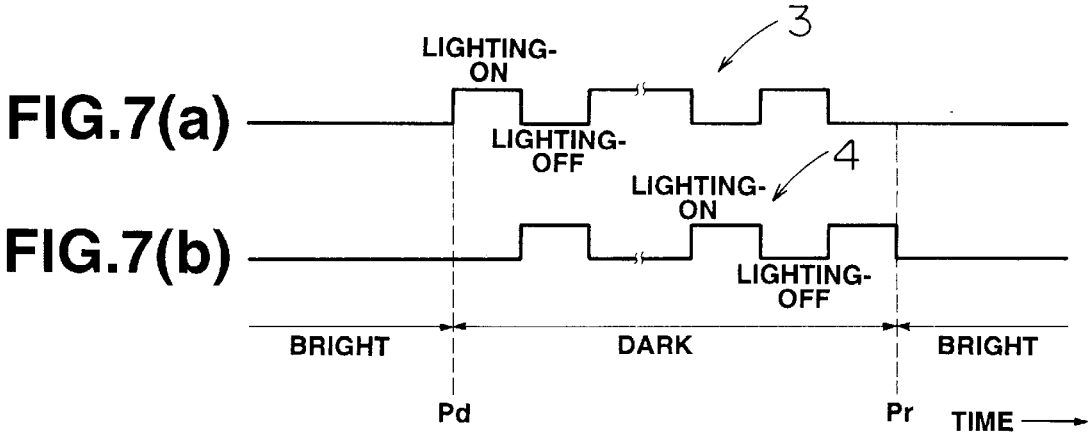

TRAFFIC SIGN MARKER

BACKGROUND OF THE INVENTION

1. Field of the Invention

The invention relates to a traffic sign marker which is located on a road.

2. Description of the Related Art

In general, various kinds of traffic sign makers are disposed on crossings, curves, etc., of roads in order to ensure smooth running and safety of automotive vehicles.

Conventionally, the traffic sign markers of this kind each include a sign plate having an applied surface portion indicating by painting, etc., any one of the graphic symbols related to various kinds of traffic signs. The sign plate is attached to an upper portion of a post positioned in the ground. However, there has been a problem that such a traffic sign marker is difficult to be recognized particularly in the night, since it merely a sign plate.

Meanwhile, there is known a traffic sign marker, for example, from Japanese Patent Application Laid Open (Kokai) No. 52 (1977)-67599, which uses a reflector as the sign plate to thereby easily recognize the traffic sign by the reflected light of the headlamp of the automotive vehicle. However, there has been a problem that the sign makers of this kind also basically cannot be recognized until immediately before the light of the headlamp of the automotive vehicle strikes thereto, which results in being insufficient in the recognitive property from a distance and the attention arousing property.

Therefore, in order to eliminate these drawbacks, there is also proposed a traffic sign marker, from Japanese Patent Application Laid Open (Kokai) No. 2 (1990)-20710, which causes the sign portion of the traffic sign to emit light by means of light emitting diodes, which is made easy to be recognized from a distance even if the light shines on the traffic sign in the night.

However, the conventional traffic sign marker which uses the light emitting diodes has the following problems to be resolved.

First, there are many cases wherein the contour of the sign portion is displayed by a plurality of points, each of which is displayed by one light emitting diode, arranged at regular intervals. In this case, only the light emitting portions can be recognized in the night. Thus, it is difficult to accurately and immediately recognize the sign portion as a traffic sign and the caution contents intended by the traffic sign.

Secondly, since the light emitting diode is sharp (narrow) in directivity of light, the brightness becomes insufficient when viewing diagonally the sign plate, whereby the sign is apt to be indistinct according to the disposition condition of the sign marker and the operating position of the automotive vehicle.

SUMMARY OF THE INVENTION

It is, therefore, an object of the invention to provide a traffic sign marker which displays alternately the graphic symbol related to a traffic sign and the letters corresponding to the graphic symbol. Thus, an operator is capable of recognizing the sign as a traffic sign and the caution contents intended by the traffic sign.

It is another object of the invention to provide a traffic sign marker which can be recognized at an angle even if the sign is displayed using the light emitting diodes, thereby being capable of recognizing surely the sign irrespective the disposition condition of the sign marker and the operating position of the automotive vehicle.

To attain the above object, there is provided, in accordance with the invention, a traffic sign 1 having a display surface portion 2 for displaying the graphic symbol A related to a traffic sign, wherein the display surface portion 2 is provided with a first light emitting portion 3 arranged along a contour of the graphic symbol A, and a second light emitting portion 4 patterning the letters B corresponding to the graphic symbol A, and the sign marker comprises an operation control portion 5 for causing the first light emitting portion 3 and the second emitting portion 4 to emit light alternately.

In this case, the first light emitting portion 3 is comprised of a plurality of light emitting diodes 3*a*, 3*b*, 3*c* . . . arranged at predetermined intervals along the contour of the graphic symbol A, and the second light emitting portion 4 is comprised of a plurality of light emitting diodes 4*a*, 4*b*, 4*c* . . . patterning the letters B.

Further, the display surface portion 2 is provided with a diode board portion 12 on which the light emitting diodes 3*a* . . . , 4*a* . . . are arranged, a semitransparent irregular reflector portion 15 disposed on a front side portion of the diode board portion 12 for reflecting irregularly lights from the light emitting diodes 3*a* . . . , 4*a* . . . , and a plurality of through holes 16 disposed on a front side portion of the irregular reflector portion 15 at positions corresponding to those of the light emitting diodes 3*a* . . . , 4*a* . . . .

Meanwhile, the operation control portion or controller 5 is comprised of a control main portion 6 for executing a control, solar batteries 7, and a battery 8 for charging an electric power outputted from the solar batteries 7. Further, the operation control portion 5 is comprised of a light sensor 10, and controls the first light emitting portion 3 and the second light emitting portion 4 to emit light alternately if the light sensor 10 senses a predetermined darkness.

Whereby, since the first light emitting portion 3 and the second light emitting portion 4 emit light alternately, the display surface portion 2 can be recognized from a distant from which the light of the headlamp cannot strike the display surface portion 2, and further, the graphic symbol A related to the traffic sign and the letters B corresponding to the graphic symbol A are displayed alternately, so that it can be recognized accurately and immediately whether or not the sign is a traffic sign and what are the caution contents intended by the traffic sign. Besides, the light which is sharp (narrow) in directivity of light, emitted from the light emitting diodes 3*a* . . . , 4*a* . . . is irregularly reflected when passing through the semitransparent irregularly reflecting portion 15 then being dispersed in directivity of light, and the irregularly reflected light is radiated from a plurality of through holes 16 . . . of the display plate portion 14 forwardly and outwardly, respectively, whereby the graphic symbol A and/or the letters B can be visible at an angle.

Further objects and advantages of the invention will be apparent from the following description of the preferred embodiment of the invention as illustrated in the accompanying drawings.

BRIEF DESCRIPTION OF THE DRAWINGS

FIG. 6 is a block circuit diagram showing an electric system of the above traffic sign marker;

FIGS. 7(*a*) and 7(*b*) are timing charts showing control timing of the first light emitting portion and the second light emitting portion of the above traffic sign marker.

DETAILED DESCRIPTION OF THE PREFERRED EMBODIMENTS

The invention will now be described in detail with reference to the drawings showing an embodiment thereof. Moreover, the accompanied drawings do not specify the invention, but makes it easy to understand the invention. Also, the detailed description is omitted for the well known portion in order to avoid to make the invention unclear.

The construction of a traffic sign marker 1 according to the embodiment will first be described with reference to FIG. 1 to FIG. 8.

Figure 1:
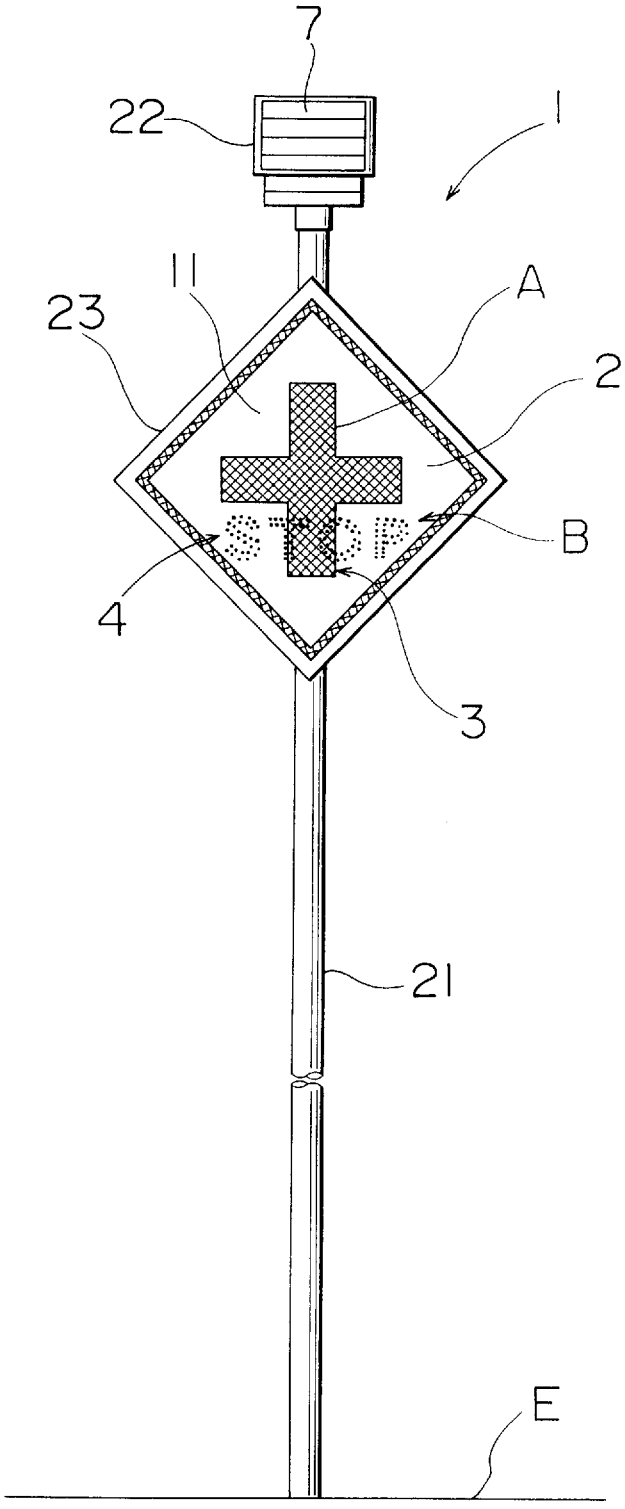
FIG. 1 is a front view of a traffic sign marker according to an embodiment of the invention.

FIG. 1 shows the entire appearance of the traffic sign 1. The traffic sign marker 1 is comprised of a post 21 made of an elongated round pipe. The post 21 is embedded on the ground E at a lower end thereof when located on a road, then erected upward. Meanwhile, a solar battery unit 22 is attached to an upper end of the post 21. The solar battery unit 22 has solar batteries 7 on an upper surface thereof, and then has a built-in battery 8 for charging an electric power outputted from the solar batteries 7 (Refer to FIG. 6). Moreover, the solar batteries 7 and the battery 8 constitute an electric power portion 9.

Figure 2:
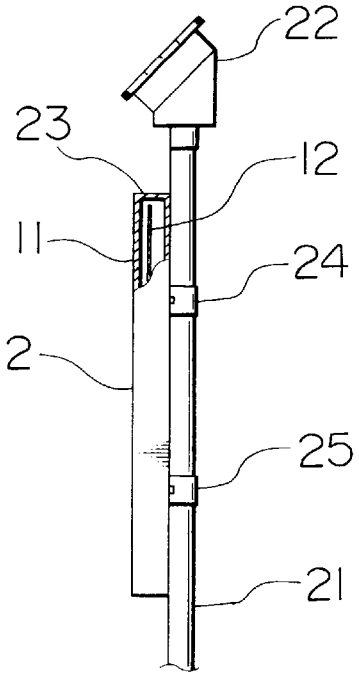
FIG. 2 is a partially sectional side view of an upper portion of the above traffic sign marker.

On the other hand, a sign unit 23 is attached to an upper portion of the post 21. That is, a rear surface of the sign unit 23 is affixed to the post 21 by using a pair of upper and lower fittings (fixing bands) 24, 25. The sign unit 23 is shaped in a hollow case as shown in FIG. 2. Moreover, a diamond-shaped display surface portion 2 is disposed on a surface portion of the sign unit 23. Also, the graphic symbol A related to the traffic sign is displayed on the display surface portion 2. In this embodiment, the display surface portion 2 is colored in yellow on the whole, then the graphic symbol A shaped in a cross showing crossroads is drawn in black at a center thereof. Such a traffic sign is defined by road traffic regulations, etc.

Figure 3:
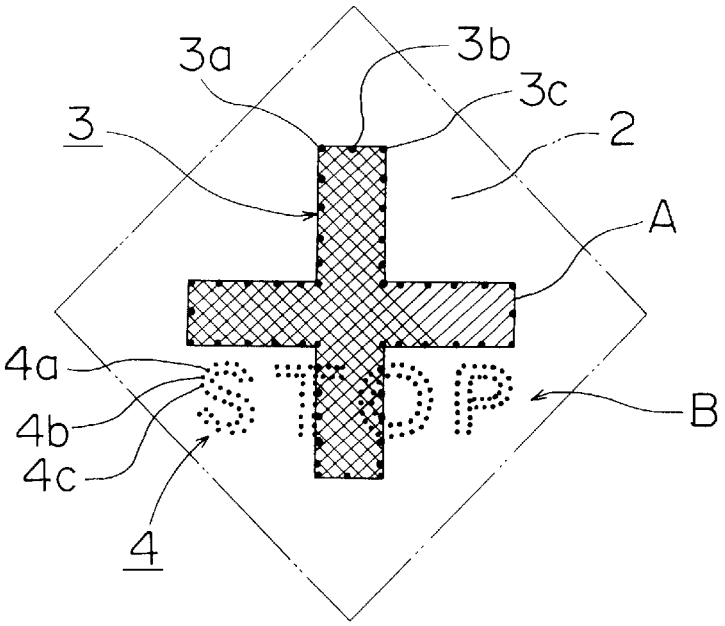
FIG. 3 is a front view of a display surface portion of the above traffic sign marker of FIG. 1 viewed in the daytime.
Figure 5:
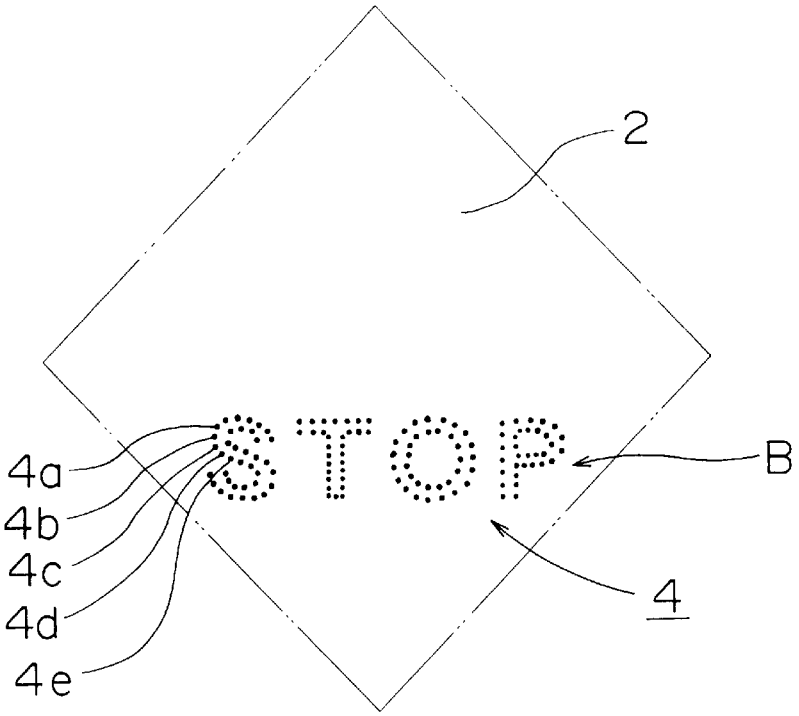
FIG. 5 is a front view of a display surface portion of the above traffic sign marker viewed in the night when the second light emitting portion emits light.

A first light emitting portion 3 is attached to the display surface portion 2 along a contour of the graphic symbol A. The first light emitting portion 3 is comprised of a plurality of light emitting diodes 3*a*, 3*b*, 3*c*, 3*d*, 3*e* . . . arranged along the contour of the graphic symbol A. The light emitting diodes 3*a* . . . are preferably red in color. Also, a second light emitting portion 4 patterning the letters B corresponding to the graphic symbol A are attached to the display surface portion 2. On this occasion, since the graphic symbol A represents a crossing, the letters B of "STOP" representing a temporary stop are selected as the letters corresponding to the graphic symbol A. The second light emitting portion 4 is comprised of a plurality of light emitting diodes 4*a*, 4*b*, 4*c*, 4*d*, 4*e* . . . patterning the letters B, as shown in FIG. 3 and FIG. 5. The light emitting diodes 4*a* . . . are preferably red in color.

Figure 8:
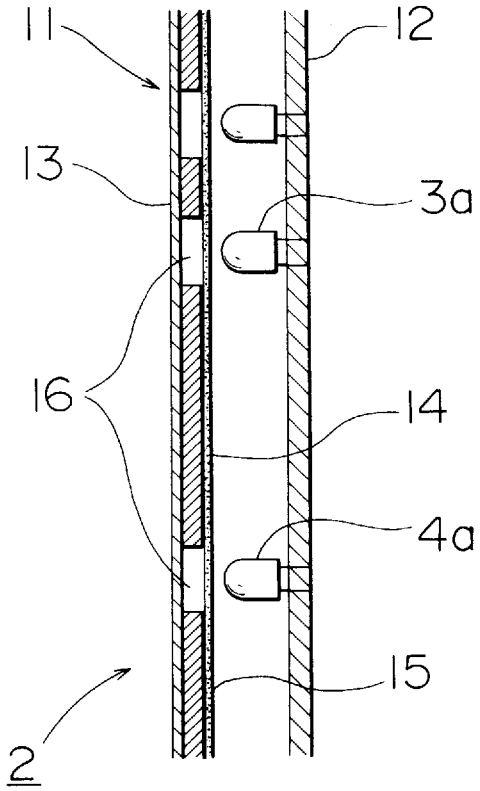
FIG. 8 is a sectional side view showing an internal construction of a part f the above traffic sign marker.

The concrete construction of the display surface portion 2 is shown in FIG. 8. The display surface portion 2 is comprised of a display board portion 11 and a diode board portion 12 arranged on a rear surface of the display board portion 11 oppositely, and then the light emitting diodes 3*a*, 3*b* . . . , and 4*a*, 4*b* . . . are mounted on a front surface portion of the diode board plate 12. The surface board plate 11 is constituted by piling a transparent outer cover 13 of the front portion, a display plate portion 14 of an intermediate portion, and the irregularly reflecting portion 15 of the aftermost portion. The display plate portion 14 has a thickness of 1 to 5 mm, and has a plurality of through holes 16 . . . of a diameter of 5 to 10 mm penetrating therethrough, at positions corresponding to the respective light emitting diodes 3*a*, 3*b* . . . , and 4*a*, 4*b* . . . . Further, the irregularly reflecting plate portion 15 is made of a semitransparent polycarbonate sheet, etc.

Since the directivity of light emitted from the light emitting diodes 3*a* . . . usually is sharp (narrow), the relatively narrow range with respect to the front face only can receive sufficient brightness. However, there is provided with the display board portion 11 in the invention, the light emitted from the light emitting diodes 3*a* . . . which is irregularly reflected at the irregularly reflecting plate portion 15, and then the irregularly reflected light is radiated through the through holes 16 forwardly and outwardly, which results in the improvement of the directivity of light of the light emitting diodes 3*a* . . . , to thereby make them visible at an angle. Moreover, the distance between the light emitting diodes 3*a* . . . and the irregularly reflecting plate portion 15 is preferably set to 0.1 to 2.0 mm, thereby being capable of changing the directivity of light.

Moreover, a control main body portion 6 is provided for executing control for making the first light emitting portion 3 and the second light emitting portion 4 emit light alternately. The battery 8 and a light sensor 10 for sensing the brightness/darkness are connected to the control main body portion 6, respectively, as shown in FIG. 6. Incidentally, the control main body portion 6 and the electric source portion 9 constitute the operation control portion 5.

Next, the operation of the traffic sign marker 1 according to this embodiment will now be described with reference to FIG. 3 to FIG. 8.

First, the control main body portion 6 is on a stop condition in the daytime, since the light sensor 10 senses the brightness. Accordingly, both the first light emitting portion 3 and the second light emitting portion 4 do not emit light. Therefore, the traffic sign (graphic symbol A) displayed on the display surface portion 2 can be recognized as it is in the daytime, as shown in FIG. 3. Also, the electric power outputted from the solar batteries 7 is charged to the battery 8 in the daytime.

When it becomes dark, and then the light sensor 10 senses a predetermined darkness, the control main body portion 6 executes a control for making the first light emitting portion 3 and the second light emitting portion 4 emit light alternately. That is, as shown in FIG. 7*a*, when the light sensor 10 senses a predetermined darkness at a time point Pd, the first light emitting portion 3 and the second light emitting portion 4 are illuminated and turned off repeatedly and alternately. On this occasion, the time periods of the lighting-on and the lighting-off can be set to several seconds, and can be optionally adjusted by an adjusting function of the control main body portion 6.

Figure 4:
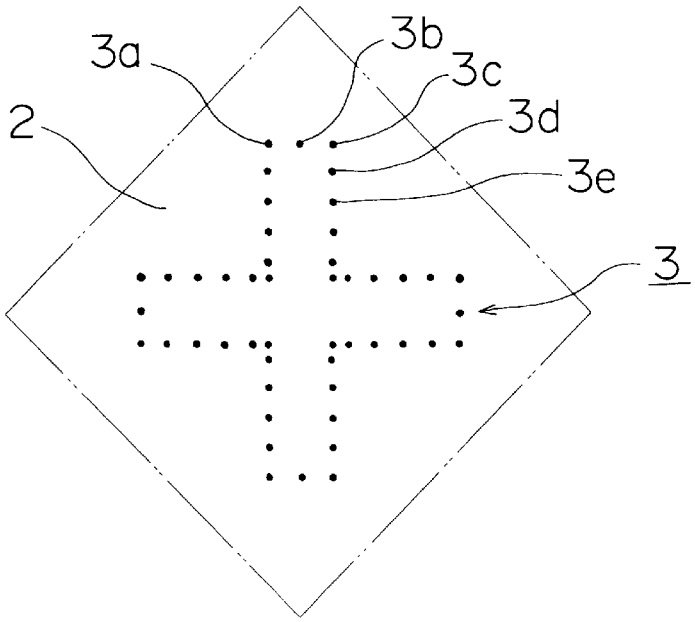
FIG. 4 is a front view of a display surface portion of the above traffic sign marker viewed in the night when the first light emitting portion emits light.

FIG. 4 shows a condition in which the first light emitting portion 3 is illuminated. The first light emitting portion 3 represents a contour of the graphic symbol A related to the traffic sign. On the other hand, FIG. 5 shows a condition in which the second light emitting portion 4 is illuminated. The second light emitting portion 4 represents the letters B of "STOP" corresponding to the graphic symbol A in red. Moreover, when morning rises, i.e. it becomes bright at the time point Pr in FIG. 7*b*, the control main body portion 6 becomes on the operation stop condition since the light sensor 10 senses the brightness. Accordingly, both the first light emitting portion 3 and the second light emitting portion 4 stop to emit light.

According to the traffic sign marker 1, the light which is sharp (narrow) in directivity of light, emitted from the light emitting diodes 3*a* . . . , 4*a* . . . is irregularly reflected when passing through the semitransparent irregularly reflecting portion 15 then being dispersed in directivity of light, and the irregularly reflected light is radiated from a plurality of through holes 16 . . . of the display plate portion 14 forwardly and outwardly, respectively, whereby the graphic symbol A and/or the letters B can be visible at an angle. Besides, since the first light emitting portion 3 and the second light emitting portion 4 emit light alternately, the display surface portion 2 can be recognized from a distant from which the light of the headlamp cannot strike the display surface portion 2, and further, the graphic symbol A related to the traffic sign and the graphic symbol B corresponding to the graphic symbol A are displayed alternately, it can be recognized accurately and immediately whether or not the sign is a traffic sign and what are the caution contents intended by the traffic sign.

The embodiment of the invention are described above in detail. However, the invention is not restricted to the embodiment. Otherwise, the detailed construction, the shape and the material and the like of the invention can be optionally modified as long as they are not deviated from the gist of the invention, and then can be omitted or added as the occasion demands. For example, the displaying traffic sign is not limited to the illustrated embodiment, but any other various kinds of traffic signs may be employed.

What is claimed is:

1. A traffic sign marker comprising:

a display surface portion displaying a graphic symbol related to a traffic sign;

a first light emitting portion arranged along a contour of said graphic symbol;

a second light emitting portion pattering letters corresponding to the graphic symbol;

a diode board portion on which said first and second light emitting diodes are arranged;

a semitransparent irregular reflector portion disposed on a front side portion of said diode board portion for reflecting irregularly lights from said light emitting diodes;

a plurality of through holes displayed on a front side portion of said irregular reflector portion at positions corresponding to those of said first and second light emitting diodes; and an operation controller for causing said first light emitting portion and said second emitting portion to be illuminated alternately.

2. The traffic sign marker as claimed in claim 1, wherein said first light emitting portion includes a plurality of light emitting diodes arranged at predetermined intervals along said contour of said graphic symbol.

3. The traffic sign marker as claimed in claim 2, wherein said operation controller includes a light sensor, and controls said first light emitting portion and said second light emitting portion to emit light alternately if said light sensor senses a predetermined darkness.

4. The traffic sign marker as claimed in claim 1, wherein said second light emitting portion includes a plurality of light emitting diodes patterning said letters.

5. The traffic sign marker as claimed in claim 4, wherein said operation controller includes a light sensor, and controls said first light emitting portion and said second light emitting portion to emit light alternately if said light sensor senses a predetermined darkness.

6. The traffic sign marker as claimed in claim 1, wherein said operation controller includes a control main portion for executing a control, solar batteries, and a battery for charging an electric power outputted from said solar batteries.

7. The traffic sign marker as claimed in claim 1, wherein said operation controller includes a light sensor, and controls said first light emitting portion and said second light emitting portion to emit light alternately if said light sensor senses a predetermined darkness.

* * * * *